US011801653B2

(12) United States Patent
Wang et al.

(10) Patent No.: US 11,801,653 B2
(45) Date of Patent: Oct. 31, 2023

(54) SPECIAL HYDRAULIC PRESS FOR BULGING PRESSING FORMING OF AUTOMOBILE AXLE HOUSING AND PRESSING FORMING METHOD

(71) Applicants: Qinhuangdao Tongqiao Technology Co., Ltd., Hebei (CN); Yanshan University, Hebei (CN)

(72) Inventors: Liandong Wang, Hebei (CN); Chen Liang, Hebei (CN); Lei Ma, Hebei (CN); Xiaodi Wang, Hebei (CN); Xiliang Song, Hebei (CN); Dongfeng Yang, Hebei (CN); Na Wu, Hebei (CN); Jiaqi Zhang, Hebei (CN); Hailing Deng, Hebei (CN)

(73) Assignees: Qinhuangdao Tongqiao Technology Co., Ltd., Qinhuangdao (CN); Yanshan University, Qinhuangdao (CN)

( * ) Notice: Subject to any disclaimer, the term of this patent is extended or adjusted under 35 U.S.C. 154(b) by 395 days.

(21) Appl. No.: 17/013,777

(22) Filed: Sep. 7, 2020

(65) Prior Publication Data

US 2021/0129472 A1 May 6, 2021

(30) Foreign Application Priority Data

Nov. 5, 2019 (CN) ..... 201911070787.8

(51) Int. Cl.

| | |
|---|---|
| ***B30B 1/34*** | (2006.01) |
| ***B21D 26/043*** | (2011.01) |
| ***B21D 37/10*** | (2006.01) |
| ***B21D 53/90*** | (2006.01) |
| ***B30B 9/28*** | (2006.01) |
| ***B30B 15/02*** | (2006.01) |
| ***B30B 15/04*** | (2006.01) |

(52) U.S. Cl.

CPC ..... *B30B 1/34* (2013.01); *B21D 26/043* (2013.01); *B21D 37/10* (2013.01); *B21D 53/90* (2013.01); *B30B 9/28* (2013.01); *B30B 15/02* (2013.01); *B30B 15/041* (2013.01)

(58) Field of Classification Search

CPC ..... B30B 15/02; B30B 15/041; B30B 1/34; B30B 9/28; B21D 26/043; B21D 37/10

USPC ..... 72/60, 57

See application file for complete search history.

(56) References Cited

U.S. PATENT DOCUMENTS

2004/0200550 A1* 10/2004 Pfaffmann ..... B21D 37/16 148/526

* cited by examiner

*Primary Examiner* — Jimmy T Nguyen
*Assistant Examiner* — Smith Oberto Bapthelus
(74) *Attorney, Agent, or Firm* — Dragon Sun Law Firm, PC; Nathaniel Perkins

(57) ABSTRACT

The present invention discloses a special hydraulic press for bulging pressing forming of an automobile axle housing and a pressing forming method. A hydraulic press body is a closed frame consisting of an upper cross beam, a lower cross beam, four stand columns I, II, III, and IV, four vertical pull rods I, II, III, and IV, and four transverse pull rods I, II, III, and IV, and is used for balancing a deformation force up to 3000 T in the vertical direction or the horizontal direction in the pressing forming process. During pressing forming, the downward speeds of a main hydraulic cylinder, small left and right vertical hydraulic cylinders are precisely controlled to prevent the left end, the right end and the middle of the tube blank from bending.

7 Claims, 4 Drawing Sheets

Direction B

Direction C

SPECIAL HYDRAULIC PRESS FOR BULGING PRESSING FORMING OF AUTOMOBILE AXLE HOUSING AND PRESSING FORMING METHOD

TECHNICAL FIELD

The present invention relates to the field of automotive manufacturing technology, and in particular to a special hydraulic press for bulging pressing forming of an automobile axle housing and a pressing forming method of the automobile axle housing.

BACKGROUND

As one of the major support members of an automobile, an automobile axle housing has a complex geometric shape, and is a tube piece with a complex shape. Two ends of the tube piece are circular tubes, and the middle thereof is a bulge with a rear oil cap. Straight tubes with a square cross section are provided between the circular tubes at the two ends and the bulge. The performance of an automobile axle housing directly affects the safety and reliability of a transportation vehicle and needs to have sufficient strength and rigidity, and the mass of the automobile axle housing needs to be minimized to implement smoother driving of the vehicle. At present, an automobile axle housing is mainly manufactured by using a method of casting, stamping, and welding. The wall thickness of a cast axle housing is adequately distributed. However, a manufactured part has large mass, and there is pollution in production. A stamped and welded axle housing has small mass. However, the utilization of materials is low, a manufactured part has a long weld seam, and the weak seam is prone to oil leakage. To completely change a conventional method for manufacturing an automobile axle housing and eliminate various disadvantages thereof, a steel-tube bulging pressing forming method of an automobile axle housing is disclosed recently, in which a seamless steel tube with specifications is chosen. Diameter reduction is first performed at two ends of the steel tube, and then hydraulic bulging is performed in the middle, to obtain an almost spheroidal preformed tube blank. Finally, liquid filling and pressing forming are performed to obtain an axle housing tube piece with a rear cover and an additional front cover. The additional front cover is cut to obtain an axle housing body. An axle housing manufactured by using the bulging pressing forming method is integrally formed and free of weld seams and has smaller mass than a cast axle housing and higher strength than a stamped and welded axle housing.

Chinese Patent 201310019329.8 discloses a method for integrally forming an axle housing without a weld seam for light- and medium-duty trucks. A seamless steel circular tube is chosen. Early-stage diameter reduction is first performed at two ends of the circular tube, and hydraulic bulging is performed twice in the middle. Later-stage diameter reduction is then performed at the two ends to obtain an axially symmetrical or approximately axially symmetrical preformed tube blank. A pressing forming die is used on a four-direction hydraulic press to seal two end parts of the preformed tube blank. A liquid is filled inside the tube blank. Overall pressing forming is then performed in an upward direction, a downward direction, a forward direction, and a backward direction. Circular tube parts with the outer diameter de at the two end parts of the tube blank are not deformed. A circular tube with the outer diameter $d_1$ on the inner side is deformed into an $h_0 \times b_0$ rectangular tube. A single drum with one half larger than the other half on the central part is deformed into a semi-finished axle housing product with a hemispherical rear oil cap and an additional front cover. The additional front cover is cut off to obtain the axle housing product (FIG. 1, FIG. 2, and FIG. 3).

Chinese Patent 201610308062.8 discloses a liquid-filling pressing forming die of an axle housing tube piece for heavy- and medium-duty automobiles, which mainly includes components such as an upper die, a lower die, a front die, a rear die, a left pressing head, a right pressing head, an upper die base, a lower die base, a left die template, a right die template, hydraulic cylinders I and II, a liquid-filling high-pressure tube, a relief high-pressure tube, a top rod, and liquid collecting grooves I and II. The structures of the components of the die are disclosed. The liquid-filling pressing forming die of an axle housing tube piece for heavy- and medium-duty automobiles is mounted on a four-direction hydraulic press. The upper die is mounted on an upper slider of the hydraulic press through the upper die base. The lower die is mounted on a lower slider of the hydraulic press through the lower die base. The left (right) pressing head is mounted on a left (right) slider of the hydraulic press through the left (right) die template. During pressing forming, the left slider and the right slider respectively drive the left pressing head and the right pressing head of the pressing forming die to perform a working feed from the left side and the right side toward the middle to seal two ends of the tube blank. The upper slider drives the upper die to press the tube blank from upward to downward. The lower slider drives the lower die to press the tube blank from downward to upward. The upper slider and the lower slider are respectively driven by two independent large hydraulic cylinders. In addition, working feed speeds of the upper slider and the lower slider need to be precisely controlled in the pressing forming process of the tube blank.

An automobile drive axle has heavy dead weight. The structural size of an axle housing is large. The weight of a single large axle housing exceeds 100 kg. A pressing force required during liquid-filling pressing forming of a preformed tube blank by using the bulging pressing forming process is up to 3000 T. In addition, in the pressing forming process of the preformed tube blank, a downward pressing amount in the middle of the tube blank is different from downward pressing amounts at circular tubes at two ends thereof. The forming process needs to be precisely controlled, otherwise the left and right ends of the tube blank tend to bend to cause leakage of the sealing at the left pressing head and the right pressing head. As a result, an axle housing tube piece cannot be formed. As for the special hydraulic press for bulging pressing forming of an automobile axle housing, the four-direction hydraulic press in Chinese Patent 201610308062.8 is used. The upper slider and the lower slider are respectively driven by two independent hydraulic systems. Two large hydraulic cylinders and fitting components are required. The equipment has a complex structure and a high manufacturing cost. In addition, in the pressing forming process, it is very difficult to precisely control the working feed speeds of the upper slider and the lower slider, making it difficult to ensure that the left and right ends of the tube blank are not bended. At present, there are still no documents and reports on a special hydraulic press for bulging pressing forming of an automobile axle housing in engineering practice.

SUMMARY

To resolve the problem that there is no special hydraulic press for bulging pressing forming of an automobile axle housing in engineering practice at present, the present invention provides a special hydraulic press for bulging pressing forming of an automobile axle housing and a pressing forming method of the automobile axle housing.

The technical solution adopted in the present invention to resolve the technical problem thereof is a special hydraulic press for bulging pressing forming of an automobile axle housing, including a hydraulic system, an electrical system, a pressurization system, front and rear high-pressure jacks, and a pressing forming die, where the pressing forming die includes an upper die, a lower die, a front die, a rear die, a left pressing head, a right pressing head, an upper die base, and a lower die base. A lower cross beam of the special hydraulic press is an inverted-"T"-shaped case structure, an upper cross beam is a "T"-shaped case structure, the front and rear ends of left and right stepped surfaces of the lower cross beam and the upper cross beam are respectively supported by four stand columns I, II, III, and IV to form a closed frame structure, the upper cross beam and the lower cross beam are respectively connected in the vertical direction by four vertical pull rods I, II, III, and IV for balancing external forces applied to the upper cross beam and the lower cross beam in the vertical direction when the hydraulic press is operating, and the upper cross beam and the lower cross beam are respectively connected to upper end parts and lower end parts of the four stand columns I, II, III, and IV in the horizontal direction by four transverse pull rods I, II, III, and IV for balancing external forces applied to the four stand columns I, II, III, and IV in the left-right direction when the hydraulic press is operating;

a main hydraulic cylinder is mounted upside down on the upper cross beam, a lower end of a piston rod of the main hydraulic cylinder is connected to the top surface of a main slider by a flange, the main slider is connected to the upper die base, and the main hydraulic cylinder drives the upper die base and the upper die to move in the vertical direction;

a left vertical slider is located between the two left stand columns I and II, a right vertical slider is located between the two right stand columns III and IV, the left vertical slider is movable in the vertical direction between the two left stand columns I and II, the right vertical slider is movable in the vertical direction between the two right stand columns III and IV, the bottom surfaces of the left vertical slider and the right vertical slider are respectively connected to piston rods of a left vertical hydraulic cylinder and a right vertical hydraulic cylinder, the left vertical hydraulic cylinder and the right vertical hydraulic cylinder are small hydraulic cylinders, and the cylinder bottoms of the left vertical hydraulic cylinder and the right vertical hydraulic cylinder are respectively mounted in the middle of the left stepped surface and the right stepped surface of the lower cross beam;

the left vertical slider and the right vertical slider are both case structures, a left horizontal hydraulic cylinder and a right horizontal hydraulic cylinder are respectively mounted in the middle of inner sides of the left vertical slider and the right vertical slider, and guide sleeves I, II, III, and IV and guide sleeves V, VI, VII, and VIII are respectively disposed on the upper part and lower part of the left vertical slider and the right vertical slider;

piston rods of the left horizontal hydraulic cylinder and the right horizontal hydraulic cylinder are respectively connected to a left horizontal slider and a right horizontal slider so as to drive the left pressing head and the right pressing head to move leftwards and rightwards in the horizontal direction, left guide rods I, II, III, and IV and right guide rods V, VI, VII, and VIII are respectively provided at the upper part and lower part of the left horizontal slider and the right horizontal slider, and the left guide rods I, II, III, and IV and the right guide rods V, VI, VII, and VIII slide in the guide sleeves I, II, III, and IV and the guide sleeves V, VI, VII, and VIII respectively disposed in the left vertical slider and the right vertical slider; and a worktable is mounted in the middle of the upper plane of the lower cross beam, and the lower die base is mounted in the upper plane of the worktable.

The upper die base is an inverted-U-shaped structure, the upper die is mounted in the lower plane of the pedestal of the upper die base, the lower die base is a U-shaped structure, the front and rear high-pressure jacks are mounted on inner side walls of the U-shaped structure, the lower die is mounted in the middle of the upper plane of the pedestal of the U-shaped structure, and the front die and the rear die are mounted on front and rear sides of the lower die.

The front and rear high-pressure jacks drive the front die and the rear die to press a preformed tube blank from outside to inside on the upper plane of the lower die base.

The pressurization system is formed by a low-pressure pressurizer, a high-pressure pressurizer and a high-pressure relief valve.

A pressing forming method of a special hydraulic press for bulging pressing forming of an automobile axle housing includes the following steps:

(1) placing a preformed tube blank of an automobile axle housing in a die cavity of a lower die, the tube blank being accurately positioned in the left-right direction and the front-rear direction;

(2) operating left and right horizontal hydraulic cylinders of the hydraulic press so as to drive a left pressing head and a right pressing head to perform a working feed from outside to inside through left and right horizontal sliders, thereby sealing left and right end parts of the preformed tube blank;

(3) operating front and rear high-pressure jacks operate so as to drive a front die and a rear die to press the preformed tube blank from outside to inside, until inner side planes of left and right end parts of the front die and the rear die contact outside surfaces at the left and right ends of the lower die;

(4) operating a main hydraulic cylinder of the hydraulic press so as to drive an upper die base through a main slider to move downward and stop until a die cavity of an upper die contacts an upper curved surface of the preformed tube blank;

(5) filling the preformed tube blank with a liquid through the left pressing head by using a low-pressure pressurizer of a pressurization system, and stopping filling the liquid when the pressure inside the tube blank reaches a pressure $p_0$=6 MPa to 20 MPa;

(6) operating the main hydraulic cylinder of the hydraulic press so as to drive the upper die to press downward the preformed tube blank at a speed $v_1$, simultaneously driving, by left and right vertical hydraulic cylinders, left and right vertical sliders to move downward at a speed $v_2$, stopping the pressing of the upper die when a distance between two end surfaces of the upper die and two end surfaces of the lower die reaches $b_0$, and keeping the pressure $p_0$ inside the tube blank unchanged in the pressing process;

(7) filling the preformed tube blank with a liquid through the left pressing head by using a high-pressure pressurizer of the pressurization system, and stopping filling the liquid when the pressure inside the tube blank reaches a pressure $p_1$=60 MPa to 120 MPa;

(8) operating a relief valve of the pressurization system mounted on the right pressing head so as to unload the high-pressure liquid inside a formed tube piece;

(9) making the left and right horizontal hydraulic cylinders of the hydraulic press return so as to detach the left pressing head and the right pressing head from the end parts of the tube piece;

(10) driving, by the main hydraulic cylinder of the hydraulic press, the upper die to return;

(11) making the front and rear high-pressure jacks return so as to drive the front die and the rear die to return;

(12) driving, by the left and right vertical hydraulic cylinders, the left and right vertical sliders to move upward so as to drive the left pressing head and the right pressing head to return to an initial position; and

(13) retrieving the piece, and dumping the liquid in the formed tube piece.

During the overall pressing forming of the preformed tube blank, the main hydraulic cylinder drives the upper die through the main slider to press downward the middle of the preformed tube blank at a speed $v_1$, and the left vertical hydraulic cylinder and the right vertical hydraulic cylinder drive the left pressing head and the right pressing head through a left vertical slider and a right vertical slider to move downward at a speed $v_2$, wherein the speed $v_2$ needs to appropriately match the speed $v_1$, namely $v_2$=(0.45 to 0.55)$v_1$, so as to ensure that the left end, the right end and the middle of the tube blank are prevented from bending in the pressing forming process.

The beneficial effects of the present invention are as follows:

(1) In the special hydraulic press for bulging pressing forming of an automobile axle housing, a closed frame formed by an upper cross beam, a lower cross beam, four stand columns, four vertical pull rods and four transverse pull rods is used for balancing a deformation force up to 3000 T in the vertical direction or the horizontal direction in the pressing forming process. In addition, only one large main hydraulic cylinder is used for providing a pressing force in the vertical direction. In addition, the present invention has advantages such as an optimized structure and low production and manufacturing costs.

(2) In the overall pressing forming process of an axle housing tube piece of an automobile, an upper die is driven by one large main hydraulic cylinder to press downward the middle of a tube blank at a constant speed, and the downward speeds of small left and right vertical hydraulic cylinders are precisely controlled, so that a left pressing head and a right pressing head are controlled to drive the end parts of the tube blank to move downward, and it is ensured that the left end, the right end and the middle of the tube blank are prevented from bending in the pressing forming process.

Figure 1:
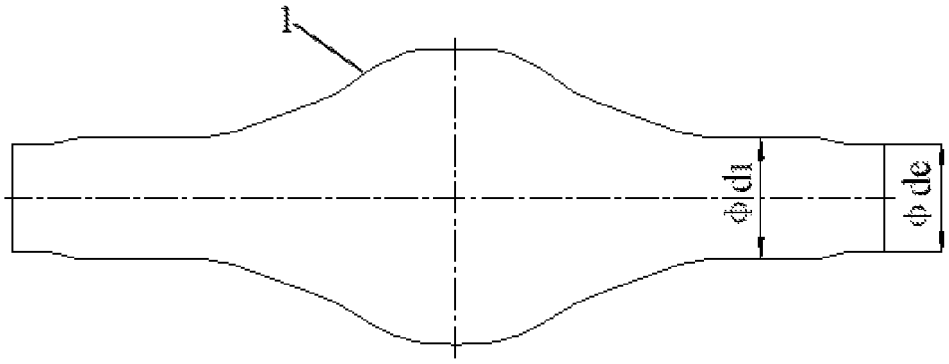
FIG. 1 illustrates a schematic diagram of a preformed tube blank of an automobile axle housing formed through bulging pressing.

In the accompanying drawings: 1. preformed tube blank, 2. additional front cover of the automobile axle housing, 3. rear cover of the automobile axle housing, 4. lower cross beam, 4*a*. left stepped surface of the lower cross beam, 4*b*. right stepped surface of the lower cross beam, 5*a*. stand column I, 5*b*. stand column II, 5*c*. stand column III, 5*d*. stand column IV, 6. left pressing head, 7. left horizontal slider, 7*a*. left guide rod I, 7*b*. left guide rod II, 7*c*. left guide rod III, 7*d*. left guide rod IV, 8. left vertical slider, 9. main slider, 10. upper cross beam, 10*a*. left stepped surface of the upper cross beam, 10*b*. right stepped surface of the upper cross beam, 11*a*. vertical pull rod I, 11*b*. vertical pull rod II, 11*c*. vertical pull rod III, 11*d*. vertical pull rod IV, 12. main hydraulic cylinder, 13*a*. transverse pull rod I, 13*b*. transverse pull rod II, 13*c*. transverse pull rod III, 13*d*. transverse pull rod IV, 14. right vertical slider, 15. right pressing head, 16. right horizontal hydraulic cylinder, 17. right vertical hydraulic cylinder, 18. right horizontal slider, 18*a*. right guide rod I, 18*b*. right guide rod II, 18*c*. right guide rod III, 18*d*. right guide rod IV, 19. rear die, 20. lower die base, 21. front die, 22. upper die base, 23. worktable, 24. left horizontal hydraulic cylinder, 25. left vertical hydraulic cylinder, 26*a*, front high-pressure jack, 26*b*. rear high-pressure jack, 27. lower die, 28. upper die, 29*a*. guide sleeve I, 29*b*. guide sleeve II, 29*c*. guide sleeve III, 29*d*. guide sleeve IV, 29*e*. guide sleeve V, 29*f*. guide sleeve VI, 29*g*. guide sleeve VII, and 29*h*. guide sleeve VIII.

DESCRIPTION OF EMBODIMENTS

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure is thorough and complete, and will fully convey the scope of the invention to those skilled in the art. Like reference numerals refer to like elements throughout.

Embodiment

Figure 2:
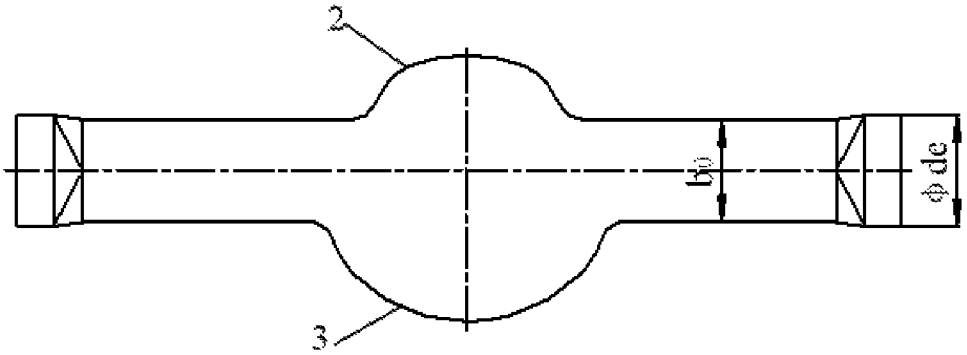
FIG. 2 illustrates a front view of a tube piece formed through pressing of an automobile axle housing formed through bulging pressing.
Figure 3:
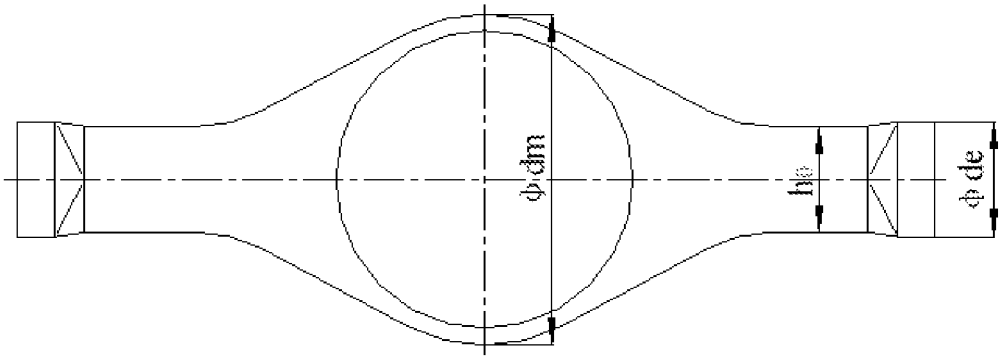
FIG. 3 illustrates a top view of a tube piece formed through pressing of an automobile axle housing formed through bulging pressing.
Figure 4:
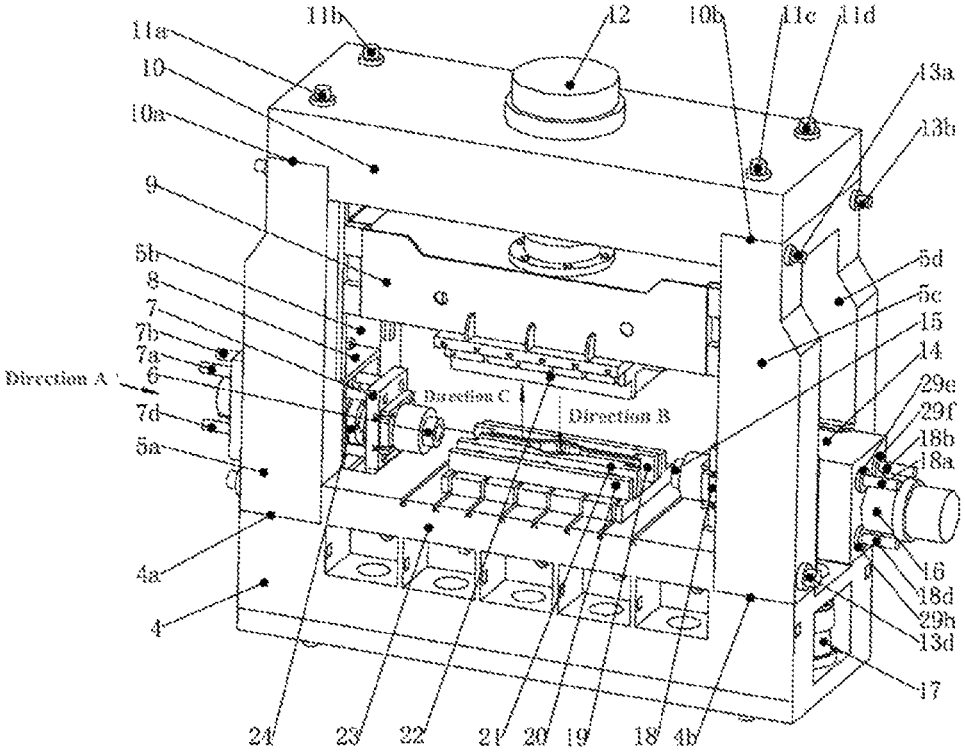
FIG. 4 illustrates a front view of a body structure of a special hydraulic press for bulging pressing forming of an automobile axle housing.
Figure 5:
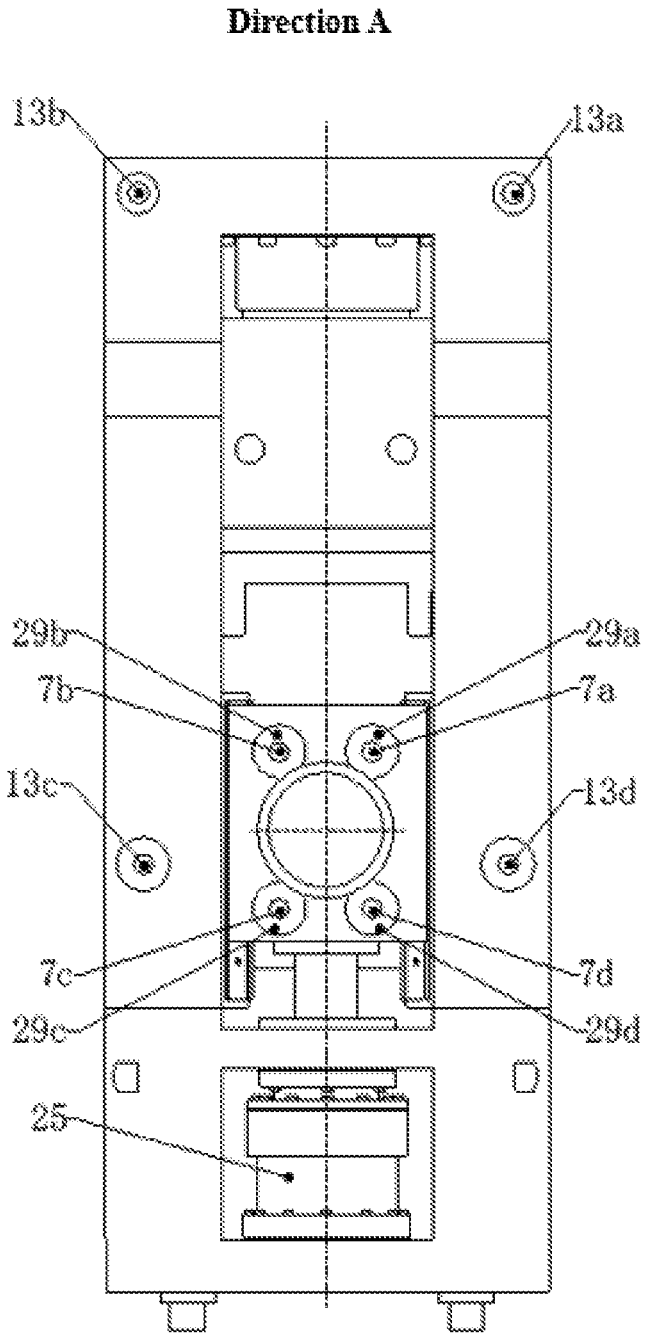
FIG. 5 illustrates a partial schematic structural diagram in a direction A of a front view of a body structure of a special hydraulic press for bulging pressing forming of an automobile axle housing.
Figure 6:
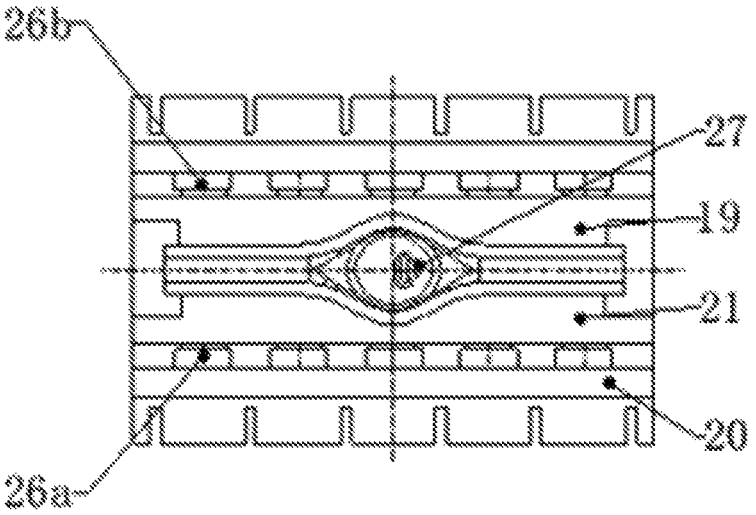
FIG. 6 illustrates a partial schematic structural diagram in a direction B of a front view of a body structure of a special hydraulic press for bulging pressing forming of an automobile axle housing.
Figure 7:
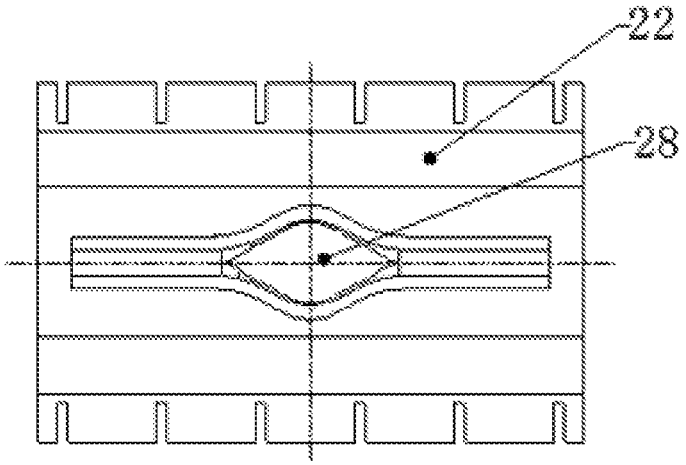
FIG. 7 illustrates a partial schematic structural diagram in a direction C of a front view of a body structure of a special hydraulic press for bulging pressing forming of an automobile axle housing.

FIG. 1 shows a preformed tube blank 1 of a large automobile axle housing formed through bulging pressing. The outer diameter $d_e$ of circular tubes at two ends of the preformed tube blank 1 is equal to Φ170 mm, and the outer diameter $d_1$ of a circular tube on the inner side of the circular tube at each of the two ends is equal to Φ188 mm FIG. 2 and FIG. 3 are respectively a front view and a top view of a large automobile axle housing formed through bulging pressing. The height $h_0$ of a straight tube with a square cross section on the inner side of the circular tube is equal to 158 mm, and the width $b_0$ is equal to 158 mm.

A special hydraulic press for bulging pressing forming of an automobile axle housing is provided. The hydraulic press is formed by components such as a hydraulic press body, a hydraulic system, an electrical system, a pressing forming die, a pressurization system, and front and rear high-pressure jacks (26*a*, 26*b*). The pressing forming die is formed by an upper die base 22, a lower die base 20, an upper die 28, a lower die 27, a front die 21, a rear die 19, a left pressing head 6, and a right pressing head 15. The upper die base 22 is an inverted-U-shaped structure. The upper die 28 is mounted in the lower plane of the pedestal of the upper die base 22. The lower die base 20 is a U-shaped structure. The front and rear high-pressure jacks (26*a*, 26*b*) are mounted on inner side walls of the U-shaped structure. The lower die 27 is mounted in the middle of the upper plane of the pedestal of the U-shaped structure. The front die 21 and the rear die 19 are mounted on front and rear sides thereof. The pressurization system is formed by a low-pressure pressurizer, a high-pressure pressurizer and a high-pressure relief valve. The hydraulic press body includes an upper cross beam 10, a lower cross beam 4, four stand columns I, II, III, and IV (5*a*, 5*b*, 5*c*, 5*d*), four vertical pull rods I, II, III, and IV (11*a*, 11*b*, 11*c*, 11*d*), four transverse pull rods I, II, III, and IV (13*a*, 13*b*, 13*c*, 13*d*), a main slider 9, a main hydraulic cylinder 12, a left vertical slider 8, a right vertical slider 14, a left vertical hydraulic cylinder 25, a right vertical hydraulic cylinder 17, a left horizontal hydraulic cylinder 24, a right horizontal hydraulic cylinder 16, a left horizontal slider 7, a right horizontal slider 18, a worktable 23, and the like.

The lower cross beam 4 is an inverted-"T"-shaped case. The upper cross beam 10 is a "T"-shaped case. The front and rear ends of left and right stepped surfaces (10*a*, 10*b*, 4*a*, 4*b*) of the upper cross beam 10 and the lower cross beam 4 are respectively supported by the four stand columns I, II, III, and IV (5*a*, 5*b*, 5*c*, 5*d*) to form a closed frame. The upper cross beam 10 and the lower cross beam 4 are respectively connected in the vertical direction by the four vertical pull rods I, II, III, and IV (11*a*, 11*b*, 11*c*, and 11*d*) for balancing external forces applied to the upper cross beam 10 and the lower cross beam 4 in the vertical direction when the hydraulic press is operating. The upper cross beam 10 and the lower cross beam 4 are respectively connected to upper end parts and lower end parts of the four stand columns I, II, III, and IV (5*a*, 5*b*, 5*c*, 5*d*) in the horizontal direction by the four transverse pull rods I, II, III, and IV (13*a*, 13*b*, 13*c*, 13*d*) for balancing external forces applied to the stand columns I, II, III, and IV (5*a*, 5*b*, 5*c*, 5*d*) in the left-right direction when the hydraulic press is operating.

The main hydraulic cylinder 12 is mounted upside down on the upper cross beam 10, a lower end of a piston rod of the main hydraulic cylinder 12 is connected to the top surface of the main slider 9 by a flange, the main slider 9 is connected to the upper die base 22 of the pressing forming die, and the main hydraulic cylinder 12 drives the upper die base 22 and the upper die 28 to move in the vertical direction.

The left vertical slider 8 is located between the two left stand columns I and II (5*a*, 5*b*). The right vertical slider 14 is located between the two right stand columns III and IV (5*c*, 5*d*). The left vertical slider 8 is movable in the vertical direction between the two left stand columns I and II (5*a*, 5*b*). The right vertical slider 14 is movable in the vertical direction between the two right stand columns III and IV (5*c*, 5*d*). The bottom surfaces of the left vertical slider 8 and the right vertical slider 14 are respectively connected to piston rods of the left vertical hydraulic cylinder 25 and the right vertical hydraulic cylinder 17. The left vertical hydraulic cylinder 25 and the right vertical hydraulic cylinder 17 are small hydraulic cylinders. The cylinder bottoms of the left vertical hydraulic cylinder 25 and the right vertical hydraulic cylinder 17 are respectively mounted in the middle of the left stepped surface 4*a* and the right stepped surface 4*b* of the lower cross beam 4.

The left vertical slider 8 and the right vertical slider 14 are both case structures. The left horizontal hydraulic cylinder 24 and the right horizontal hydraulic cylinder 16 are respectively mounted in the middle of inner sides of the left vertical slider 8 and the right vertical slider 14. Guide sleeves I, II, III, and IV (29*a*, 29*b*, 29*c*, 29*d*) and guide sleeves V, VI, VII, and VIII (29*e*, 29*f*, 29*g*, 29*h*) are respectively disposed on the upper part and lower part of the left vertical slider 8 and the right vertical slider 14. Piston rods of the left horizontal hydraulic cylinder 24 and the right horizontal hydraulic cylinder 16 are respectively connected to the left horizontal slider 7 and the right horizontal slider 18 so as to drive the left pressing head 6 and the right pressing head 15 to move leftwards and rightwards in the horizontal direction. Left guide rods I, II, III, and IV (7*a*, 7*b*, 7*c*, 7*d*) and right guide rods V, VI, VII, and VIII (18*a*, 18*b*, 18*c*, 18*d*) are respectively provided at the upper part and lower part of the left horizontal slider 7 and the right horizontal slider 18, and slide in the guide sleeves I, II, III, and IV (29*a*, 29*b*, 29*c*, 29*d*) and the guide sleeves V, VI, VII, and VIII (29*e*, 29*f*, 29*g*, 29*h*) respectively disposed in the left vertical slider 8 and the right vertical slider 14.

The worktable 23 is mounted in the middle of the upper plane of the lower cross beam 4. The lower die base 20 of the pressing forming die is mounted on the upper plane of the worktable 23. The front and rear high-pressure jacks (26*a*, 26*b*) mounted on the U-shaped inner side walls of the lower die base 20 during pressing forming drive the front die 21 and the rear die 19 to press the preformed tube blank 1 from outside to inside on the upper plane of the lower die base 20.

A forming method of pressing an automobile axle housing by a special hydraulic press for bulging pressing forming of an automobile axle housing includes the following process steps:

(1) placing a preformed tube blank 1 of an automobile axle housing in a die cavity of a lower die 27, the tube blank being accurately positioned in the left-right direction and the front-rear direction;

(2) operating left and right horizontal hydraulic cylinders (24, 16) of the hydraulic press so as to drive a left pressing head 6 and a right pressing head 15 of a pressing forming die to perform a working feed from outside to inside through left and right horizontal sliders (7, 18), thereby sealing left and right end parts of the preformed tube blank 1;

(3) operating front and rear high-pressure jacks (26*a*, 26*b*) so as to drive a front die 21 and a rear die 19 to press the preformed tube blank 1 from outside to inside, until inner side planes of left and right end parts of the front die 21 and the rear die 19 contact outside surfaces at the left and right ends of the lower die 27;

(4) operating a main hydraulic cylinder 12 of the hydraulic press so as to drive an upper die base 22 through a main slider 9 to move downward and stop until a die cavity of an upper die 28 contacts an upper curved surface of the preformed tube blank 1;

(5) filling the preformed tube blank 1 with an emulsion through the left pressing head 6 by using a low-pressure pressurizer of a pressurization system, and stopping filling the emulsion when the pressure inside the tube blank reaches a pressure $p_0$=12 MPa;

(6) operating the main hydraulic cylinder 12 of the hydraulic press so as to drive the upper die 28 to press downward the preformed tube blank 1 at a speed $v_1$ equal to 3.5 mm/s, simultaneously driving, by left and right vertical hydraulic cylinders (25, 17), left and right vertical sliders (9, 14) to move downward at a speed $v_2$, stopping the pressing of the upper die 28 when a distance between two end surfaces of the upper die 28 and two end surfaces of the lower die 27 reaches $b_0$, and keeping the pressure $p_0$ inside the tube blank unchanged in the pressing process;

(7) filling the preformed tube blank 1 with an emulsion through the right pressing head 15 by using a high-pressure pressurizer of the pressurization system, and stopping filling the emulsion when the pressure inside the tube blank reaches a pressure $p_1$=80 MPa;

(8) operating a relief valve of the pressurization system mounted on the right pressing head 15 so as to unload the high-pressure liquid inside a formed tube piece;

(9) making the left and right horizontal hydraulic cylinders (24, 16) of the hydraulic press return so as to detach the left pressing head 6 and the right pressing head 15 from the end parts of the tube piece;

(10) driving, by the main hydraulic cylinder 12 of the hydraulic press, the upper die 28 to return;

(11) making the front and rear high-pressure jacks (26*a*, 26*b*) return so as to drive the front die 21 and the rear die 19 to return;

(12) driving, by the left and right vertical hydraulic cylinders (25, 17), the left and right vertical sliders (9, 14) to move upward so as to drive the left pressing head 6 and the right pressing head 15 to return to an initial position; and

(13) retrieving the piece, and dumping the liquid in the formed tube piece.

During the overall pressing forming of the preformed tube blank 1, the main hydraulic cylinder 12 drives the upper die 28 through the main slider 9 to press downward the middle of the preformed tube blank 1 at a speed $v_1$, and the left vertical hydraulic cylinder 25 and the right vertical hydraulic cylinder 17 drive the left pressing head 6 and the right pressing head 15 of the pressing forming die through the left vertical slider 8 and the right vertical slider 14 to move downward at a speed $v_2$, wherein the speed $v_2$ ($v_2$=1.68 mm/s) needs to appropriately match the speed $v_1$, namely $v_2=0.48v_1$, so as to ensure that the left end, the right end and the middle of the preformed tube blank 1 are prevented from bending in the pressing forming process.

What is claimed is:

1. A hydraulic press for bulging pressing forming of an automobile axle housing, comprising a hydraulic system, an electrical system, a pressurization system, front and rear high-pressure jacks, and a pressing forming die, the pressing forming die comprises an upper die, a lower die, a front die, a rear die, a left pressing head, a right pressing head, an upper die base and a lower die base, wherein a lower cross beam is an inverted T-shaped case structure, an upper cross beam is a T-shaped case structure, front and rear ends of left and right stepped surfaces of the lower cross beam and the upper cross beam are respectively supported by four stand columns to form a closed frame structure, the upper cross beam and the lower cross beam are respectively connected in a vertical direction by four vertical pull rods for balancing external forces applied to the upper cross beam and the lower cross beam in the vertical direction when the hydraulic press is operating, and the upper cross beam and the lower cross beam are respectively connected to upper end parts and lower end parts of the four stand columns in a horizontal direction by four transverse pull rods for balancing external forces applied to the four stand columns in a left-right direction when the hydraulic press is operating the four stand columns comprising two left stand columns and two right stand columns a main hydraulic cylinder is mounted upside down on the upper cross beam, a lower end of a piston rod of the main hydraulic cylinder is connected to the top surface of a main slider by a flange, the main slider is connected to the upper die base, and the main hydraulic cylinder drives the upper die base and the upper die to move in the vertical direction;

a left vertical slider is located between the two left stand columns, a right vertical slider is located between the two right stand columns, the left vertical slider is movable in the vertical direction between the two left stand columns, the right vertical slider is movable in the vertical direction between the two right stand columns, the bottom surfaces of the left vertical slider and the right vertical slider are respectively connected to piston rods of a left vertical hydraulic cylinder and a right vertical hydraulic cylinder, and the cylinder bottoms of the left vertical hydraulic cylinder and the right vertical hydraulic cylinder are respectively mounted in the middle of the left stepped surface and the right stepped surface of the lower cross beam;

a left horizontal hydraulic cylinder and a right horizontal hydraulic cylinder are respectively mounted in the middle of inner sides of the left vertical slider and the right vertical slider, and guide sleeves are respectively disposed on the upper part and lower part of the left vertical slider and the right vertical slider;

piston rods of the left horizontal hydraulic cylinder and the right horizontal hydraulic cylinder are respectively connected to a left horizontal slider and a right horizontal slider so as to drive the left pressing head and the right pressing head to move leftwards and rightwards in the horizontal direction, left guide rods and right guide rods are respectively provided at the upper part and lower part of the left horizontal slider and the right horizontal slider, and the left guide rods and IV and the right guide rods slide in the guide sleeves are respectively disposed in the left vertical slider and the right vertical slider; and a worktable is mounted in the middle of an upper plane of the lower cross beam, and the lower die base is mounted in an upper plane of the worktable.

2. The hydraulic press for bulging pressing forming of an automobile axle housing according to claim 1, wherein the upper die base is an inverted-U-shaped structure, the upper die is mounted in a lower plane of the pedestal of the upper die base, the lower die base is an LT-shaped structure, the front and rear high-pressure jacks are mounted on inner side walls of the U-shaped structure, the lower die is mounted in the middle of the upper plane of the pedestal of the U-shaped structure, and the front die and the rear die are mounted on front and rear sides of the lower die.

3. The hydraulic press for bulging pressing forming of an automobile axle housing according to claim 2, wherein the front and rear high-pressure jacks drive the front die and the rear die to press a preformed tube blank from front side and rear side to center of the lower die base on the upper plane.

4. The hydraulic press for bulging pressing forming of an automobile axle housing according to claim 1, wherein the front and rear high-pressure jacks drive the front die and the rear die to press a preformed tube blank from front side and rear side to center of the lower die base on the upper plane.

5. The hydraulic press for bulging pressing forming of an automobile axle housing according to claim 1, wherein the pressurization system is formed by a low-pressure pressurizer, a high-pressure pressurizer and a high-pressure relief valve.

6. A forming method of pressing an automobile axle housing by a hydraulic press for bulging pressing forming of an automobile axle housing, wherein the forming method comprises the following steps:

a. placing a preformed tube blank of an automobile axle housing in a die cavity of a lower die, the preformed tube blank being accurately positioned in a left-right direction and a front-rear direction;

b. operating a left and a right horizontal hydraulic cylinders of the hydraulic press so as to drive a left pressing head and a right pressing head to perform a working feed from outside to inside through left and right horizontal sliders, thereby sealing left and right end parts of the preformed tube blank;

c. operating a front and a rear high-pressure jacks so as to drive a front die and a rear die to press the preformed tube blank from front side and rear side to center of the lower die base, until an inner side planes of left and right end parts of the front die and the rear die contact outside surfaces at the left and right ends of the lower die;

d. operating a main hydraulic cylinder of the hydraulic press so as to drive an upper die base through a main slider to move downward and stop until a die cavity of an upper die contacts an upper curved surface of the preformed tube blank;

e. filling the preformed tube blank with a liquid through a left pressing head by using a low-pressure pressurizer of a pressurization system, and stopping filling the liquid when the pressure inside the preformed tube blank reaches a pressure $p_0$=6 MPa to 20 MPa;

f. operating the main hydraulic cylinder of the hydraulic press so as to drive the upper die to press downward the preformed tube blank at a speed $v_1$, simultaneously driving, by left and right vertical hydraulic cylinders, left and right vertical sliders to move downward at a speed $v_2$, stopping the pressing of the upper die when a distance between two end surfaces of the upper die and two end surfaces of the lower die reaches $b_0$, and keeping the pressure $p_0$ inside the preformed tube blank unchanged in the pressing process;

g. filling the preformed tube blank with the liquid through a right pressing head by using a high-pressure pressurizer of the pressurization system, and stopping filling the liquid when the pressure inside the preformed tube blank reaches a pressure $p_1$=60 MPa to 120 MPa;

h. operating a relief valve of the pressurization system mounted on the right pressing head so as to unload the high-pressure liquid inside the preformed tube blank;

i. making the left and right horizontal hydraulic cylinders of the hydraulic press return so as to detach the left pressing head and the right pressing head from the end parts of the preformed tube blank;

j. driving, by the main hydraulic cylinder of the hydraulic press, the upper die to return;

k. making the front and rear high-pressure jacks return so as to drive the front die and the rear die to return;

l. Driving, by the left and right vertical hydraulic cylinders, the left and right vertical sliders to move upward so as to drive the left pressing head and the right pressing head to return to an initial position; and m. retrieving the blank, and dumping the liquid in the preformed tube blank.

7. The forming method of pressing an automobile axle housing by a hydraulic press for bulging pressing forming of an automobile axle housing according to claim 6, wherein during the overall pressing forming of the preformed tube blank, the main hydraulic cylinder drives the upper die through the main slider to press downward the middle of the preformed tube blank at a speed $v_1$, and the left vertical hydraulic cylinder and the right vertical hydraulic cylinder drive the left pressing head and the right pressing head through the left vertical slider and the right vertical slider to move downward at a speed $v_2$, wherein the speed $v_2$ needs to appropriately match the speed $v_1$, namely $v_2=v_1$, so as to ensure that the left end, the right end and the middle of the preformed tube blank are prevented from bending in the pressing forming process.

* * * * *